US006641007B2

(12) United States Patent
Chung et al.

(10) Patent No.: US 6,641,007 B2
(45) Date of Patent: Nov. 4, 2003

(54) UNIVERSAL CONTAINER WITH PAIL AND RETRACTABLE POURING SPOUT IN LID

(75) Inventors: Su Hui Chung, Taipei (TW); Antonio De Gregorio, Brooklyn, NY (US)

(73) Assignee: Preferred Market Research, Inc., Brooklyn, NY (US)

( * ) Notice: Subject to any disclaimer, the term of this patent is extended or adjusted under 35 U.S.C. 154(b) by 0 days.

(21) Appl. No.: 09/846,708

(22) Filed: May 1, 2001

(65) Prior Publication Data

US 2002/0162862 A1 Nov. 7, 2002

(51) Int. Cl.[7] ..... B65D 51/20; B65D 25/44
(52) U.S. Cl. ..... 222/529; 222/530
(58) Field of Search ..... 222/529, 530

(56) References Cited

U.S. PATENT DOCUMENTS 2,774,523 A 12/1956 Rieke ..... 222/525
4,492,324 A * 1/1985 Weber ..... 222/529
4,560,081 A * 12/1985 Adams ..... 222/529
5,071,037 A * 12/1991 Moore et al. ..... 222/529
5,505,331 A * 4/1996 Rathbun ..... 206/506
5,743,425 A * 4/1998 Ellis ..... 220/254.2
5,950,876 A * 9/1999 McLelland et al. ..... 222/529
5,992,710 A 11/1999 Lovell et al. ..... 222/525

* cited by examiner

*Primary Examiner*—Kenneth Bomberg
(74) *Attorney, Agent, or Firm*—Darby & Darby

(57) ABSTRACT

A container including a pail and a lid with a retractable spout disposed in an opening defined in the lid. The spout is displaceable between a retracted position with said spout projecting inwardly into the pail and an extended position with the spout projecting outwardly from the lid away from the pail. The spout has a free end and an opposite end permanently secured at all times to the lid proximate the opening irrespective of the positioning of the spout. In a preferred embodiment, the lid is secured to the pail so as to form an airtight seal therebetween. The spout and lid also preferably form an airtight seal therebetween. The container is used to store any product, for example, a salt product used to melt ice on outdoor surfaces in cold weather.

41 Claims, 2 Drawing Sheets

UNIVERSAL CONTAINER WITH PAIL AND RETRACTABLE POURING SPOUT IN LID

BACKGROUND OF THE INVENTION

1. Field of the Invention

The present invention relates to a pail with a retractable spout for dispensing a substance in the form of particles or granules therefrom, in particular, an airtight pail containing salt products for melting ice and snow.

2. Description of Related Art

"Salt product" is defined herein to include particles or granules, such as calcium chloride, sodium chloride, magnesium chloride and/or other substances that are effective to melt ice and/or snow on surfaces, for example, driveways and walkways. Exposure of the salt product to the air is undesirable in that it causes clumping of the granules. Accordingly, it is desirable to package the salt product in airtight containers. Heretofore, salt products have generally been packaged in high density polyethylene (HDP) bags that are hermetically sealed. Bags of salt products are piled high onto pallets and wrapped together with an outer sheet of plastic to prevent slippage during shipping. Once the pallet has arrived at the store the outer plastic wrapping is removed, typically with a knife or other sharp instrument. The bags are highly susceptible to being slit open when the outer plastic wrap is removed from the pallet. If slit open, the salt product will be exposed to the atmosphere causing the product to clump making it less desirable to the consumer.

Another disadvantage associated with the use of HDP bags is that they are not readily stackable and prone to slippage during transport of the pallet from the manufacturer to the store. Generally the bags of salt product are sold at the store directly from the pallet on which they are shipped. Movement of the bags during transport from the manufacturer to the store may result in the uneven distribution of the bags stacked upon each other so that removal of one bag from the pallet by the consumer may result in an avalanche of other bags. Furthermore, if the bag is slit open some of the salt product may dispense therefrom and raise serious safety concerns.

The HDP bags in which the salt product is conventionally sold is not resealable. Salt product is typically sold in 10 lb., 25 lb., 50 lb., and 80 lb. bags. Since the product is sold in such large quantities, a consumer generally uses only a small quantity of the salt product with each use and there is no convenient way to easily reseal the bag to prevent clumping.

In addition, transportation and storage of the bag by the consumer is awkward. Due to the heavy weight of the typically sold bag of salt product consumers have a tendency to drag the bag or drop it on to the ground. Handling of the bag in such manner can easily result in, splits, punctures, and tears in the bag. This problem is further compounded by the fact that the bag of salt product is typically stored in a damp place, for example, the garage. As previously mentioned if salt product is exposed to moisture it will disadvantageously clump.

Pail lids with spouts have been widely used for years to provide consumers with the option of dispensing the contents of the pail through the spout. For example, U.S. Pat. No. 2,774,523 to Rieke discloses a metal liquid container or can with a pull out spout disposed in a neck of an opening defined in the lid. The patented spout is not connected to the neck or lid. When forcibly pulled upwards the spout is slidably displaced through the neck of the opening in the lid.

In a closed position, the top shoulders disposed proximate the top of the spout engage with a retaining ring disposed about a sealing plug to seal the contents within the pail. To dispense the contents of the container through the spout, the spout is pulled up through the neck by a pull tab with a sufficient amount of force so that the top shoulders of the spout pass beyond the retaining ring. The spout continues to be displaced upward until lower shoulders disposed proximate the bottom of the spout engage with the retaining ring to form a seal to prevent leakage while the contents of the pail is dispensed through the spout. The seal formed between the shoulders of the spout and retaining ring is not air tight. Accordingly, this spout is not suitable for storing a product that is not be exposed to air.

A similar lid and pouring spout apparatus is shown in U.S. Pat. No. 5,992,710 that is integrally molded in a single step. This patented device has a neck integrally formed as part of the lid. A pouring spout is located within the opening in the lid and movable between a pouring position and a retracted position. In the retracted position the spout mates with and is substantially flush with the top of the neck. As the spout is pulled upwards a gate initially connecting the spout and neck is severed allowing the spout to be slidably displaced relative to the neck and lid until a lowered chamfered portion disposed at the bottom of the spout mates with a complementary angled lower portion of the neck to form a seal therebetween. Once again the seal formed between the neck and spout is not airtight. Accordingly, such pail containers as disclosed in the aforementioned patents would not be suitable for storing a product that is best when not exposed to air.

It is therefore desirable to develop a pail that solves the aforementioned problems and has a spout for readily dispensing a product without having to remove the lid.

SUMMARY OF THE INVENTION

The present invention is a container having a pail and a lid with a retractable spout that solves the aforementioned problems.

An object of the invention is to provide a container having a pail and lid which is airtight.

Another object of the present invention is to provide a container in which the pail and lid are non-releasably sealed together so that it is child proof.

Still another object of the present invention is provide a container that is less susceptible to slits, punctures, and tears than conventional HDP bags.

One other object of the present invention is to provide a container that is made substantially from plastic so as to be recylcable without having to separate its components.

In particular, the invention is a container for storing a product. The container includes a pail, a lid secured to the top of the pail, and a spout disposed in an opening defined in the lid. The spout is displaceable between a retracted position wherein the spout projects inwardly into the pail and an extended position wherein the spout projects outwardly from the lid away from the pail. The spout has a free end and an opposite end permanently secured at all times to the lid proximate the opening irrespective of the positioning of the spout.

The invention also relates to a method for manufacturing a container as described above. One end of the spout is inserted so as to project through the opening in the lid. Thereafter, the opposite end of the spout is permanently secured to the lid proximate the opening so as to form a hermetic seal therebetween.

In addition, the invention is directed to a method for manufacturing a container, as described above, containing a product. The product is first dispensed through the open top into the pail. A lid is then non-releasably secured to the pail with the product disposed therein.

Furthermore, the invention is to a method for dispensing a product from a container, as described above, in which the product is stored. The spout is pulled from a retracted position wherein the spout projects inwardly into the pail to an extended position wherein the spout projects outwardly from the lid away from the pail. Thereafter, a closure cap is removed from the spout and the product is dispensed from the container exclusively through the spout.

BRIEF DESCRIPTION OF THE DRAWING

The foregoing and other features of the present invention will be more readily apparent from the following detailed description and drawings of illustrative embodiments of the invention wherein like reference numbers refer to similar elements throughout the several views and in which.

DETAILED DESCRIPTION OF THE INVENTION

Figure 1:
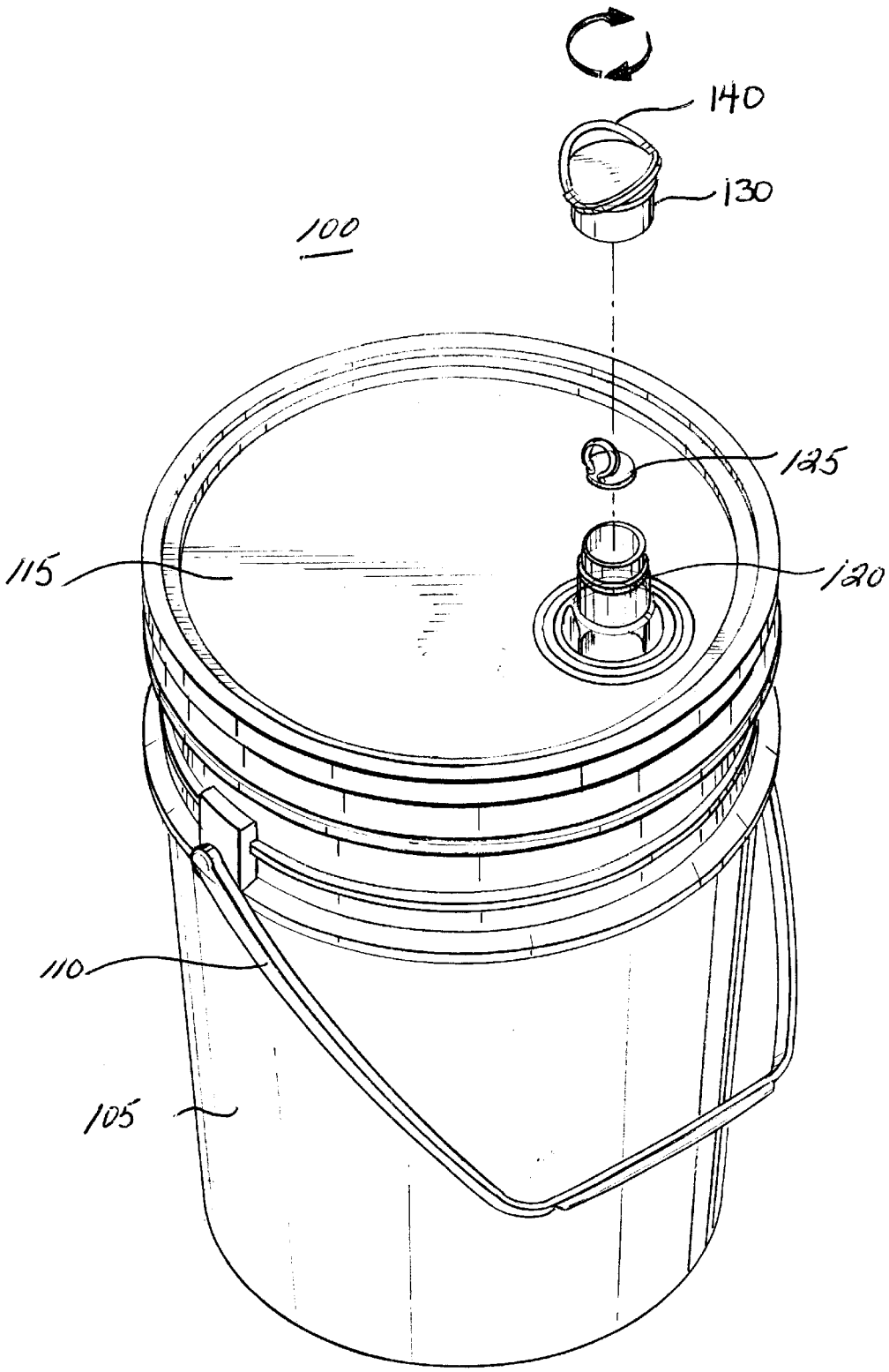
FIG. 1 is an exemplary exploded perspective view of the container in accordance with the present invention with the cap of the spout removed and the lid permanently secured to the pail.
Figure 3:
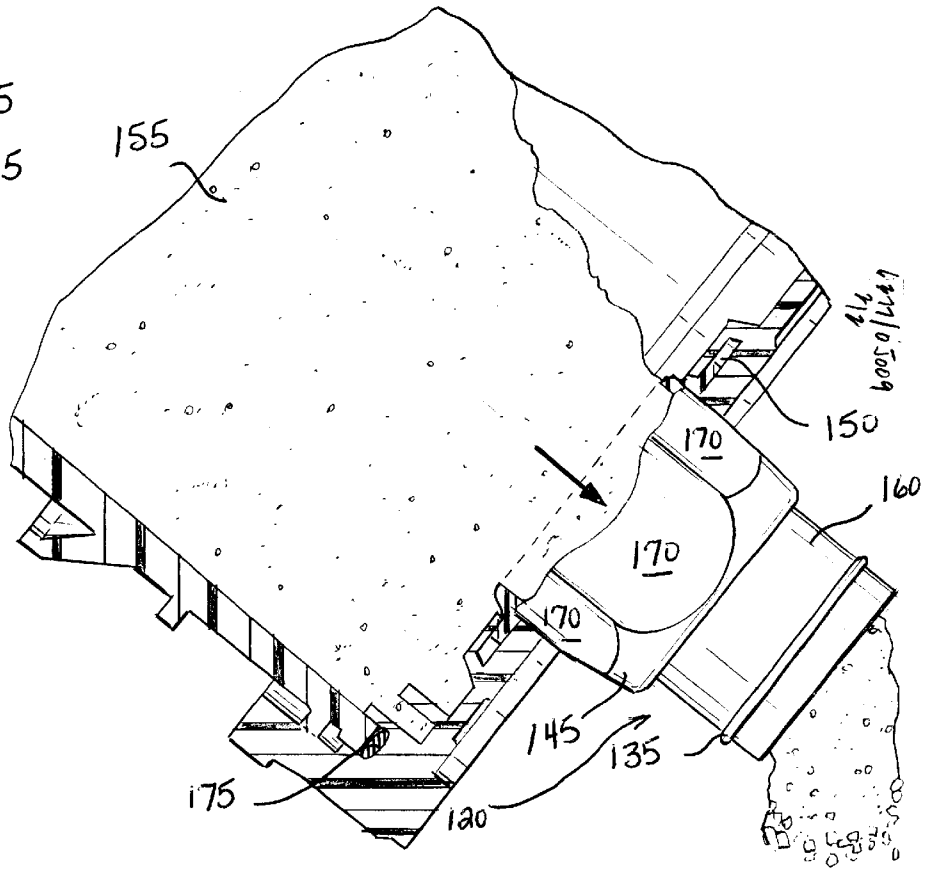
FIG. 3 is a partial cross sectional view of the container of FIG. 1 with the spout in an extended state.

FIG. 1 is an exemplary exploded perspective view of the container 100 in accordance with the present invention. Container 100 includes a pail 105 for storing a product 155, preferably a salt product, and a lid 115. Lid 115 is non-releasably sealed to the top of the pail 105, after the container 100 has been filled with the product 155. So that the only way for the seal to be broken is to destroy the lid itself. Because of the lid 115 is non-releasably sealed to the pail 105 the product can not be accessed through the large opening of the lid that otherwise may present a safety concern for use by small children should they manage to crawl into the pail and close the lid. In a preferred embodiment, a rubber gasket or ring 175 is disposed between the lid 115 and upper rim of the pail 105 to form an airtight seal.

Since the lid 115 is non-releasably sealed to the pail 105, the product 155 stored in the container 100 is dispensed exclusively through a retractable pouring spout 120 disposed in the lid 115 itself. A sealing ring 125 is disposed within or covering the opening of the spout 120 to keep the container 100 hermetically sealed prior to purchase. The consumer removes the sealing ring 125 prior to dispensing the product 155 from the container 100. A resealable closure cap 130 is placed over the free end of the spout 120. In a preferred embodiment, closure cap 130 has internal threads that engage the outer threads 135 disposed about the perimeter of the spout 120. Any other conventional resealable mechanisms may be used to secure the closure cap 130 to the spout 120. Closure cap 130 preferably includes tab rings 140 or any other mechanism used to grasp the closure cap 130 and assist in pulling the retractable spout 120 upwards from a retracted position to an extended position. In the preferred embodiment shown in FIG. 1, semi-circular tab rings 140 are disposed along the perimeter of the upper surface of the closure cap 130 and bendable upwards towards one another to form a handle.

Spout 120 is integrally formed as a single unit having three sections, namely, a flange or shoulder 150, a reconfigurable or deformable section 145, and a cylindrical section 160. Flange 150 has a larger diameter than that of the opening defined in the lid 115. During manufacture of the container 100, spout 120 is received upwards through the opening defined in the lid 115 of the container until the flange 150 is flush with the inner surface of the lid. A complementary sized ring is positioned over the flange and permanently secured together with the inner surface of the lid securing the flange in place and forming a hermetic seal therebetween. As a result, the flange 150 of the spout 120 remains permanently secured to the lid 115 at all times irrespective of the positioning of the spout.

Figure 2:
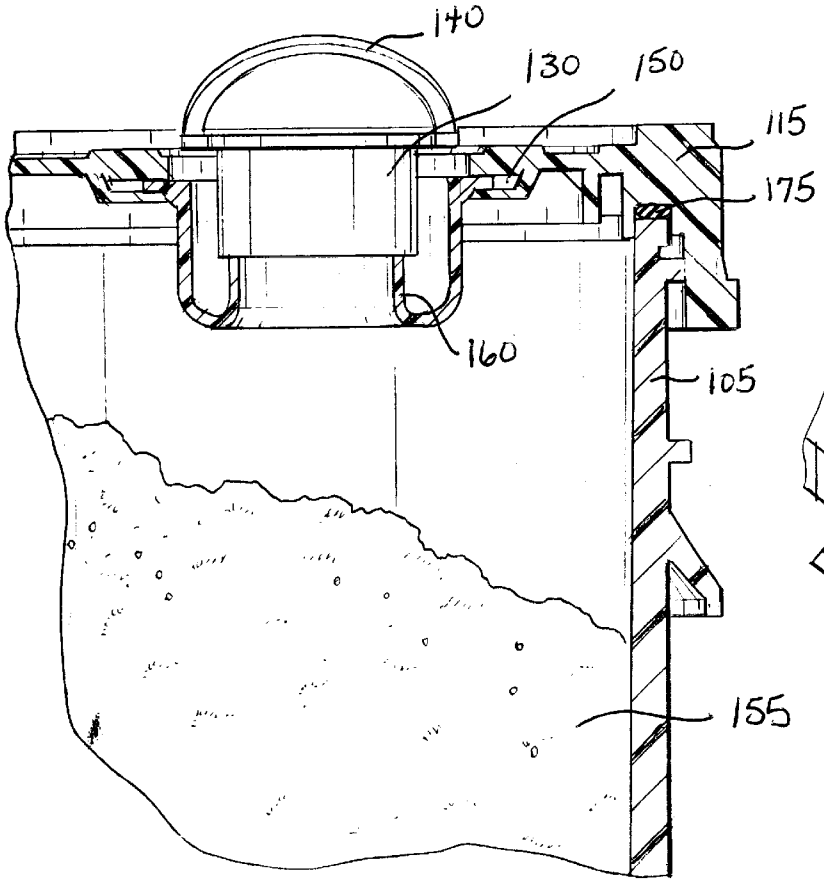
FIG. 2 is a partial cross sectional view of the container of FIG. 1 with the spout in a retracted state.

FIG. 2 is a partial cross sectional view of the container with the spout 120 in a retracted position. As is clearly shown in FIG. 2, while in a retracted position, deformable section 145 forms an outer annular wall while cylindrical section 160 forms a substantially concentric inner annular wall. Spout 120 contacts lid 115 only at its fixed end, the remaining portion of the spout 120 does not contact the lid when displaced between retracted and extended positions. In the retracted position, the spout projects inwardly into the pail 105. Cylindrical section 160 maintains it shape while the spout is pulled from the retracted position to the extended position. As the closure cap 130 is pulled upwards, the cylindrical section 160 first emerges from the opening of the lid 115. Additional pulling force applied to the closure cap causes the deformable section 145 to pass through the opening in the lid. In its extended position, spout 120 projects fully from the opening while the flange 150 remains permanently attached to the lid 115. In a preferred embodiment, deformable section 145, while in an extended position, forms a plurality of concave faces 170 that provide rigidity to the spout and assist in displacing the spout between the retracted and extended positions.

During manufacture, the container 100 is filled with a product 155*r* example, a salt product, and the lid 115 with the spout 120 is positioned on the pail 105 and non-releasably attached together, preferably forming an airtight seal therebetween. The manufactured product is then shipped to the retailer or distributor with the product in the sealed container and the spout in a retracted position. When ready for use, the consumer pulls the closure cap 130 upwards until the spout 120 is in a retracted position. Thereafter, the closure cap 130 is removed and the sealing ring 125 is broken. The product 150 is now able to be freely dispensed through the spout 120. After the desired amount of product has been dispensed from the container 100, the container may be resealed for storage by screwing the closure cap 130 back onto the spout 120 and applying a downward force on the closure cap forcing the spout back to its retracted position. In a preferred embodiment, when the spout 120 is in a retracted position the top of the closure cap 130 is substantially flush with the top of the lid 115.

By way of example, the container 100 is shown and described as being cylindrical in shape, however, any other desired shaped container may be used. The container 100 may be made from high density polyethylene. In a preferred embodiment, the pail 105, lid 115 and closure cap 130 are made from high density propylene which is more rigid than that of high density propylene and thus less plastic is required thereby reducing the overall cost of manufacture and weight of the container 100. The spout itself must be made from a deformable plastic, for example, polyvinyl chloride. The entire container is preferably made of recyclable plastic so that there is no need to separate the component parts prior to recycling. Specifically, it is desirable for the label disposed about the circumference of the pail to describe the product contained therein and the handle 110 to be made of recyclable plastic. Conventional pails are typically made of HDP. In a preferred embodiment, the container 100 in accordance with the present invention is made from high density polypropylene, that has greater rigidity than that of high density polyethylene and therefore requires less material so that the container is lighter in weight.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A container for storing a product, said container comprising:

a pail having an open top;

a lid secured to the top of said pail, said lid having an inner surface, an outer surface, and an opening defined therethrough having a first diameter; and a spout disposed in the opening of said lid, said spout being displaceable between a retracted position with said spout projecting inwardly into said pail and an extended position with said spout projecting outwardly from said lid away from said pail, said spout having a free end and an opposite end permanently secured at all times to said lid proximate the opening irrespective of the positioning of said spout and a deformable section proximate the opposite end, wherein, when said spout is in an extended state, said deformable section includes a plurality of concave faces, said plurality of concave faces circumferentially disposed about said spout.

2. The container in accordance with claim 1, wherein said spout includes a cylindrical section proximate the free end.

3. The container in accordance with claim 2, wherein, when said spout is in the retracted position, the cylindrical section forms an inner annular wall and the deformable section forms an outer annular wall substantially concentrically disposed about the inner annual wall.

4. The container in accordance with claim 1, wherein said spout includes a flange having a second diameter larger than the first diameter of the opening in said lid, said flange being fixedly secured to the inner surface of said lid.

5. The container in accordance with claim 1, wherein said spout is integrally formed as a single unit.

6. The container in accordance with claim 1, wherein the free end of said spout is permanently secured in the opening of said lid via an airtight seal.

7. The container in accordance with claim 1, further comprising a salt product disposed therein.

8. The container in accordance with claim 7, wherein said salt product is at least one of sodium chloride, calcium chloride, and magnesium chloride.

9. The container in accordance with claim 1, further comprising an airtight sealing ring to close off said spout.

10. The container in accordance with claim 1, further comprising a closure cap disposed on the free end of said spout.

11. The container in accordance with claim 10, wherein said closure cap has internal threads and said spout has complementary external threads engageable with one another when said closure cap is screwed onto the free end of said spout.

12. The container in accordance with claim 10, wherein said closure cap has at least one tab ring.

13. The container in accordance with claim 10, wherein, when said spout is in the retracted position, a top surface of said closure cap is substantially flush with a top surface of said lid.

14. The container in accordance with claim 10, wherein the closure cap hermetically seals the container.

15. The container in accordance with claim 1, wherein said container is made entirely of plastic.

16. The container in accordance with claim 15, wherein the pail and lid is made of high density polypropylene and the spout is made of polyvinyl chloride.

17. The container in accordance with claim 1, further comprising a handle attached to said pail.

18. The container in accordance with claim 17, wherein said container is made entirely of plastic.

19. The container in accordance with claim 1, wherein said product is dispensable only through said spout.

20. The container in accordance with claim 1, wherein said lid is non-releasably and hermetically sealed to the open top of said pail.

21. The container in accordance with claim 20, wherein the lid is hermetically sealed by an elastomeric seal disposed between the lid and the pail.

22. The container in accordance with claim 20, wherein the elastomeric seal comprises a rubber ring.

23. A container comprising:

a pail containing an air or moisture sensitive dry product therein;

a lid non-releaseably and hermetically engaged with the pail, the lid having an opening therein;

a spout having a free end and an opposite end, the opposite end being permanently hermetically sealed with the entirety of the opening in the lid;

the spout also having a deformable section proximate the opposite end and being displaceable between a retracted position and an extended position with the spout projecting outwardly from the lid, the deformable section including a plurality of concave faces when the spout is in the extended position, said plurality of concave faces circumferentially disposed about said spout; and a closure cap engageable with the free end of the spout in a hermetically sealing condition.

24. The container in accordance with claim 23, wherein said spout includes a cylindrical section proximate the free end.

25. The container in accordance with claim 24, wherein, when said spout is in the retracted position, the cylindrical section forms an inner annular wall and the deformable section forms an outer annular wall substantially concentrically disposed about the inner annual wall.

26. The container in accordance with claim 23, wherein said spout includes a flange having a diameter larger than that of the opening in the lid, said flange being fixedly secured to an inner surface of the lid.

27. The container in accordance with claim 23, wherein said spout is integrally formed as a single unit.

28. The container in accordance with claim 23, wherein said dry product comprises a salt product.

29. The container in accordance with claim 28, wherein said salt product is at least one of sodium chloride, calcium chloride, and magnesium chloride.

30. The container in accordance with claim 23, further comprising an airtight sealing ring to close off said spout.

31. The container in accordance with claim 23, wherein said closure cap has internal threads and said spout has complementary external threads engageable with one another when said closure cap is screwed onto the free end of said spout.

32. The container in accordance with claim 23, wherein said closure cap has at least one tab ring.

33. The container in accordance with claim 23, wherein, when said spout is in the retracted position, a top surface of said closure cap is substantially flush with a top surface of said lid.

34. The container in accordance with claim 23, wherein said container is made entirely of plastic.

35. The container in accordance with claim 34, wherein the pail and lid are made of high density polypropylene and the spout is made of polyvinyl chloride.

36. The container in accordance with claim 23, further comprising a handle attached to said pail.

37. The container in accordance with claim 36, wherein said container is made entirely of plastic.

38. The container in accordance with claim 23, wherein said dry product is dispensable only through said spout.

39. The container in accordance with claim 23, wherein the lid is hermetically sealed by an elastomeric seal disposed between the lid and the pail.

40. The container in accordance with claim 39, wherein the elastomeric seal comprises a rubber ring.

41. The container in accordance with claim 23, wherein the free end of said spout is permanently secured in the opening of said lid via an airtight seal.

* * * * *